United States Patent [19]

Slattery

[11] Patent Number: 4,509,472

[45] Date of Patent: Apr. 9, 1985

[54] STARTING ENRICHMENT OF ALTERNATE FIRING TWO CYCLE INTERNAL COMBUSTION ENGINE

[75] Inventor: Gordon C. Slattery, Omro, Wis.

[73] Assignee: Brunswick Corp., Skokie, Ill.

[21] Appl. No.: 634,657

[22] Filed: Jul. 26, 1984

Related U.S. Application Data

[63] Continuation of Ser. No. 452,912, Dec. 27, 1982, abandoned.

[51] Int. Cl.[3] ..... F02N 17/00

[52] U.S. Cl. ..... 123/179 G; 123/73 A; 123/73 R; 261/DIG. 68

[58] Field of Search ..... 123/179 G, 73 A, 73 R; 261/DIG. 8, DIG. 68, 39 D

[56] References Cited

U.S. PATENT DOCUMENTS

| | | | |
|---|---|---|---|
| 3,472,211 | 10/1969 | Meininger | 261/DIG. 68 |
| 3,759,493 | 9/1973 | Blanchard et al. | 261/DIG. 68 |
| 3,934,571 | 1/1976 | Mennesson | 123/179 G |
| 4,186,697 | 2/1980 | Yasuda et al. | 123/179 G |
| 4,333,425 | 6/1982 | Kusche | 123/73 A |
| 4,373,479 | 2/1983 | Billingsley et al. | 123/179 G |

FOREIGN PATENT DOCUMENTS

| | | | |
|---|---|---|---|
| 0596688 | 4/1934 | Fed. Rep. of Germany | 261/39 D |
| 1526650 | 1/1970 | Fed. Rep. of Germany | 123/179 G |
| 0159542 | 12/1981 | Japan | 123/179 G |

*Primary Examiner*—Parshotam S. Lall

*Attorney, Agent, or Firm*—Andrus, Sceales, Starke & Sawall

[57] ABSTRACT

A two cycle internal combustion engine (10) has at least two cylinders (12, 13) which fire alternately with pressure in one crankcase (17 or 18) at the time there is vacuum in the other. Supplemental fuel flow passages (36, 41) extend from each crankcase and are joined at a common passage (46) connected to the float bowl (30) of the carburetor (20). A normally closed control valve (48) is disposed in the common passage. When the engine is to be started, the control valve is opened so that fuel enters the supplemental and common passage. Initial rotation of the crankshaft (16) causes pressure in one crankcase to force fuel toward the other crankcase, which has vacuum. Further crankshaft rotation reverses the pressures so that fuel is then forced toward the opposite crankcase. Continued engine operation with the control valve open causes alternate fuel flow reversals together with pressurized alternate fuel injections into the respective crankcases, which are independent of the throttle setting.

8 Claims, 7 Drawing Figures

FIG.1
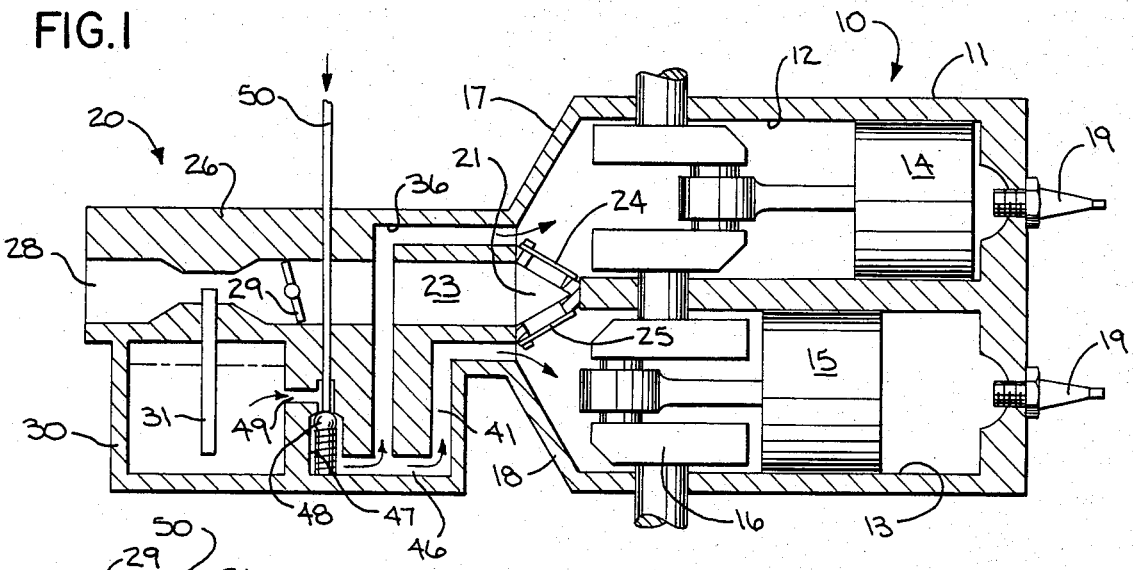
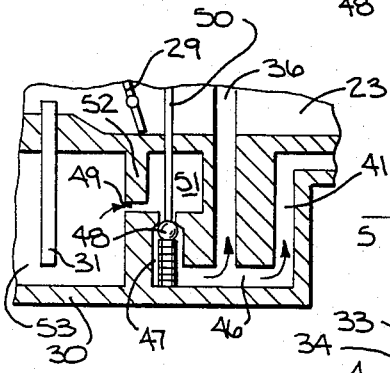
FIG.7
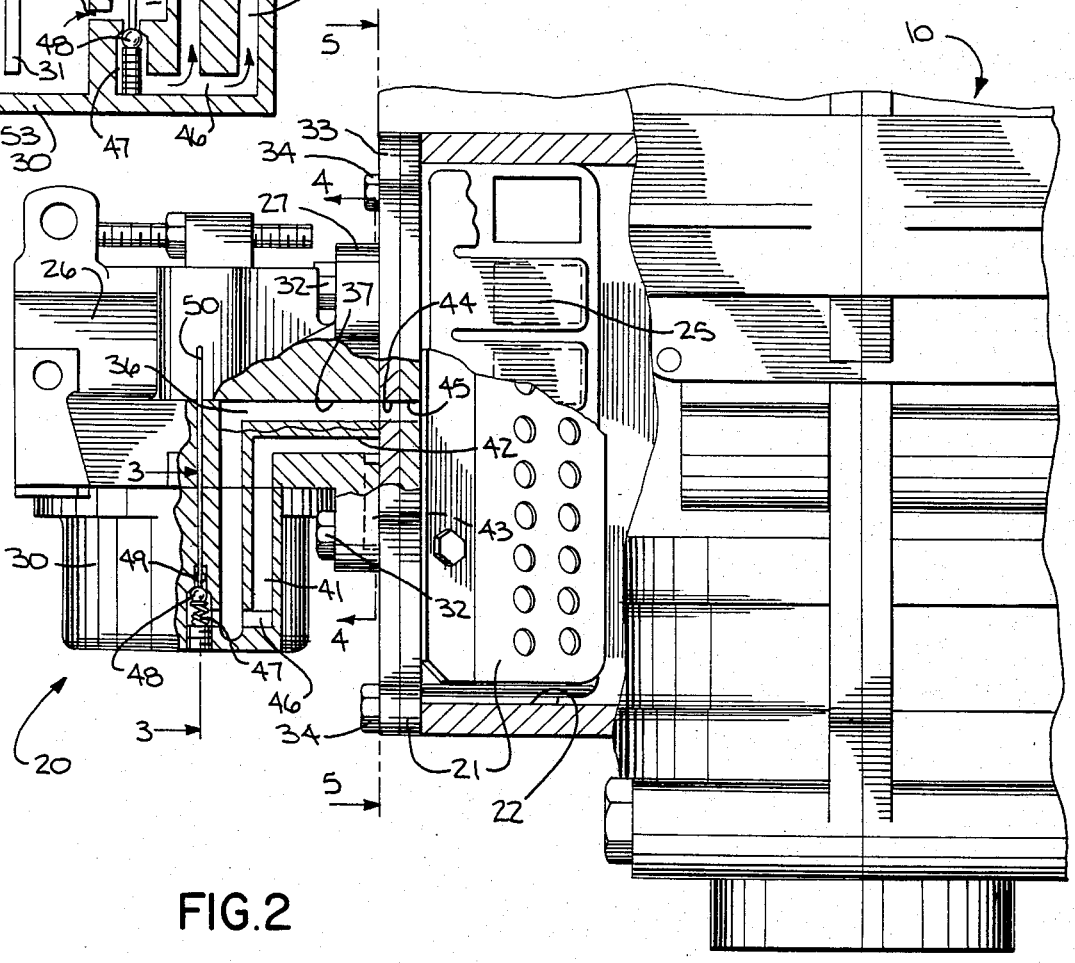
FIG.2

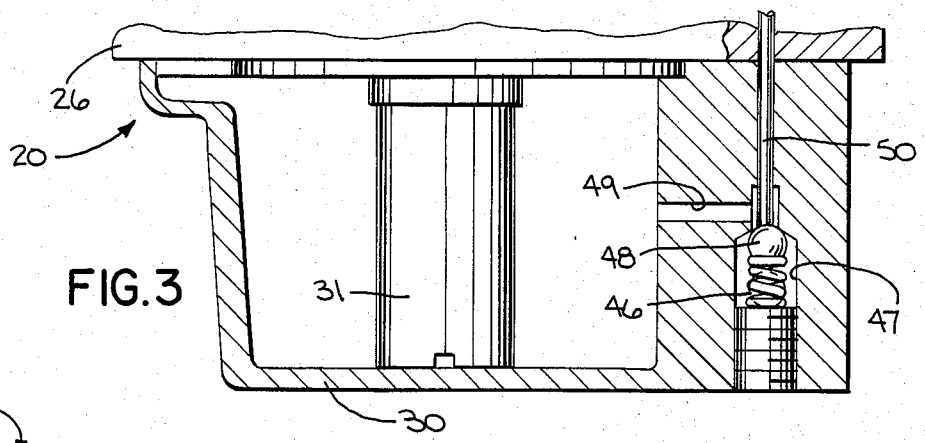
FIG.3
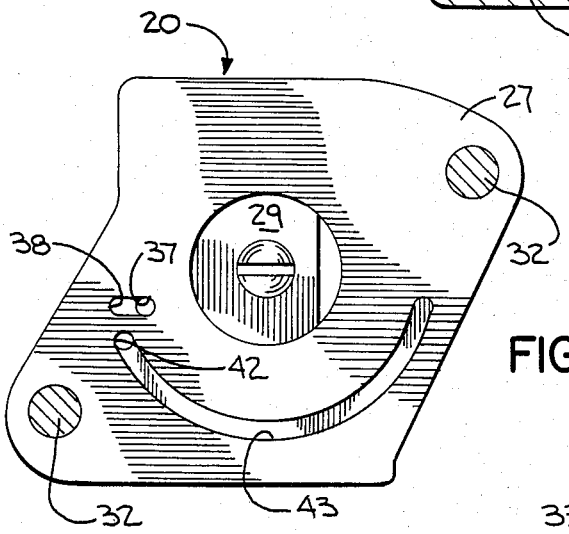
FIG.4
FIG.5
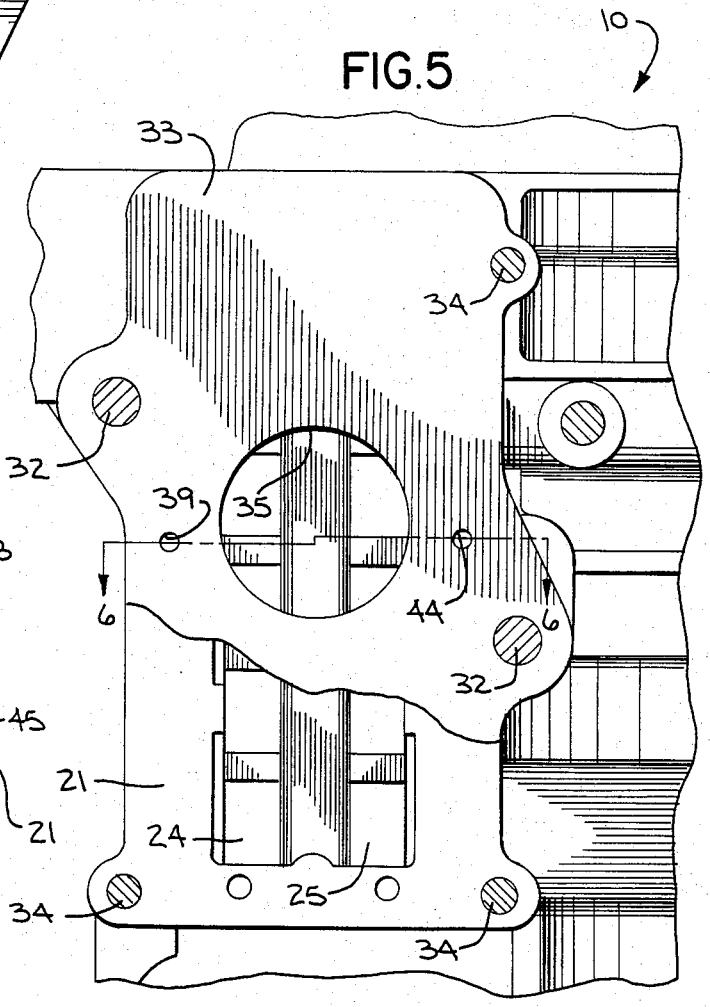
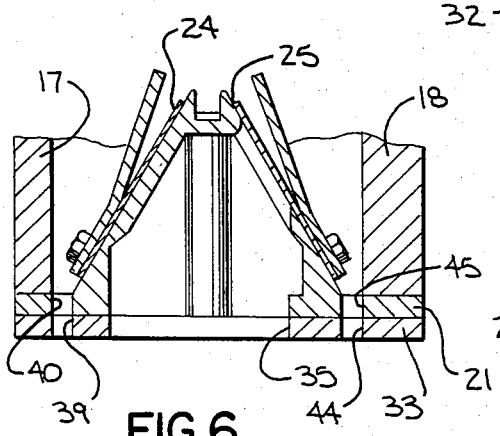
FIG.6

STARTING ENRICHMENT OF ALTERNATE FIRING TWO CYCLE INTERNAL COMBUSTION ENGINE

This is a continuation of application Ser. No. 06/452,912, filed Dec. 27, 1982, now abandoned.

DESCRIPTION

1. Technical Field

The invention relates to a starting enrichment system used in starting an alternate firing two cycle internal combustion engine.

2. Background Art

Chokes have long been used to enrich the air-fuel mixture for starting an engine.

In addition, some enrichment systems use manifold vacuum to draw fuel from the carburetor into the engine, with a requirement that the throttle be closed.

DISCLOSURE OF INVENTION

A two cycle internal combustion engine has at least two cylinders which fire alternately with pressure in one crankcase at the time there is vacuum in the other. Supplemental fuel flow passages extend from each crankcase and are joined at a common passage connected to the float bowl of the carburetor. A normally closed control valve is disposed in the common passage.

When the engine is to be started, the control valve is opened so that fuel enters the supplemental and common passages. Initial rotation of the crankshaft causes pressure in one crankcase to force fuel toward the other crankcase, which has vacuum. Further crankshaft rotation reverses the pressures so that fuel is then forced toward the opposite crankcase. Continued engine operation with the control valve open causes alternate fuel flow reversals together with pressurized alternate fuel injections into the respective crankcases, which are independent of the throttle setting.

BRIEF DESCRIPTION OF THE DRAWINGS

FIG. 1 is a schematic showing of a two cylinder internal combustion engine which incorporates the starter enrichment concept;

FIG. 2 is an enlarged front elevation of the engine with parts broken away and in section;

FIG. 3 is a vertical central section of the carburetor taken on line 3—3 of FIG. 2;

FIG. 4 is a vertical section taken on line 4—4 of FIG. 2;

FIG. 5 is a vertical section taken on line 5—5 of FIG. 2 and with parts broken away;

FIG. 6 is a section taken on line 6—6 of FIG. 5; and

FIG. 7 is a fragmentary view showing the utilization of an enrichment reservoir.

BEST MODE FOR CARRYING OUT THE INVENTION

The internal combustion engine 10 shown in the drawings is of the two cycle alternate firing type and includes a cylinder block 11 which is provided with a pair of cylinders 12 and 13 having the usual reciprocable pistons 14 and 15 respectively disposed therein. Pistons 14 and 15 move in opposite directions and are connected in the usual manner to a crankshaft 16 disposed in the crankcase 17 for piston 14 and the crankcase 18 for piston 15. The usual spark plugs 19 are provided to fire engine 10.

A fuel-air mixture is provided to crankcases 17 and 18 by a carburetor 20 which, in the normal manner, feeds the mixture through an inlet valve means which in this instance comprises a generally V-shaped flanged reed block 21. Reed block 21 is disposed in a chamber 22 located between the carburetor throat 23 and each crankcase 17 and 18 and is provided with the usual springable port-covering reed plates 24 and 25 for alternate one-way passage of the fuel-air mixture into the engine. The mixture ultimately passes to the remote side of each piston through a passage, not shown. Reference is made to U.S. Pat. No. 2,609,801 for a showing of the passage, which is conventional.

Carburetor 20 is of any suitable well-known type and includes a main body 26 having a flanged base 27, an air inlet 28 and throttle valve 29, as well as a float bowl 30 and siphon 31. Carburetor 20 is mounted to engine 10 adjacent common chamber 22, as by bolts 32. In the present embodiment, an adapter plate 33 is confined between carburetor base 27 and engine 10 and held in place by bolts 34. Adapter plate 33 is provided with an annular opening 35 communicating between chamber 22 and throat 23.

It is desired to enhance the starting of engine 10 by increasing the initial flow of fuel thereto. For this purpose, a supplemental fuel connection is provided between each crankcase 17 and 18 to carburetor 20, with the connections being completely independent of the primary carburetor outlet through throat 23 and reed block 21.

As shown in FIGS. 2 and 4–6, the supplemental connection to crankcase 17 comprises a passage 36 in float bowl 30 and carburetor body 26 which connects through a hole 37 and short groove 38 in carburetor base plate 27, with groove 38 registering with a hole 39 in adapter plate 33. A further hole 40 in the flanged base of reed block 21 registers with hole 39 for passage of fuel into crankcase 17.

The supplemental connection to crankcase 18 comprises a passage 41 in float bowl 30 and carburetor body 26 which connects through a hole 42 and elongated arcuate groove 43 in carburetor base plate 27. The end of groove 43 generally diametrically remote from hole 42 registers with a hole 44 in adapter plate 33. A further hole 45 in the flanged base of reed block 21 registers with hole 44 for passage of fuel into crankcase 18.

Referring especially to FIGS. 2 and 3, passages 36 and 41 meet or are joined by a common passage 46 disposed within the body of float bowl 30. Passage 46 extends horizontally between the terminus portions of passages 36 and 41 and hence vertically upwardly where it forms a valve chamber 47 having a spring-biased one-way ball-type valve 48 therein. Chamber 47 connects with a calibrated restrictive passage 49 which terminates within bowl 30, normally below the fuel level. Control valve 48 is manually openable by a push-rod 50 which extends to the exterior of carburetor 20.

In operation of the device, and assuming the usual level of fuel in float bowl 30 at the time of starting, control valve 48 is opened to permit fuel to flow through restrictive passage 49 and chamber 47 to common passage 46. The fuel will fill up in supplemental passages 36 and 41 to the level of fuel in float bowl 30. Crankshaft 16 is then rotated to start engine 10.

Upon initial crankshaft rotation and piston intake and compresstion strokes, positive pressure is created in crankcase 17 and vacuum is created in crankcase 18. (The crankcases could of course be reversed.) This causes an unbalance of pressure between the connected passages 36 and 41 so that the fuel therein is pressurizingly blown through passage 41 and the above-described connections and into crankcase 18, thus supplementing the usual fuel-air mixture entering from carburetor throat 23. Inlet valve 21 is bypassed.

Upon further rotation of crankshaft 16, 180°, the process reverses. That is, vacuum is created in crankcase 17 and positive pressure is created in crankcase 18. Fuel, which in the meantime has been replenished in passages 36 and 41, will now be pressurizingly blown in the opposite direction and through passage 36 and the above-described connections and into crankcase 17.

The process of injecting alternating supplemental charges of fuel into crankcases 17 and 18 continues as long as control valve 48 remains open, providing for enhanced starting and fuel rich warm-up, if desired. As soon as control valve 48 is closed, the flow of fuel to common passage 46 and passages 36 and 41 is cut off so that engine 10 will subsequently run solely on the normal fuel-air mixture from carburetor 20. During this time, air will shuttle back and forth between crankcases 17 and 18 through passages 36 and 41 and their connections, but it has been found that the power and running characteristics of engine 10 are not adversely affected thereby.

In the embodiment of carburetor 20 shown in FIGS. 2 and 3, a few seconds may elaspse from the time control valve 48 is opened until sufficient fuel has filled passages 36 and 41 to provide maximum enrichment. This time lag may be eliminated, if desired, by the embodiment shown in FIG. 7. In that embodiment, an enrichment reservoir 51 may be disposed between restrictive passage 49 and control valve 48, with passage 49 being disposed in a partition member 52 separating the main float bowl fuel chamber 53 from reservoir 51.

In the embodiment of FIG. 7, as supplemental fuel is alternately injected into crankcases 17 and 18, fuel in reservoir 51 will be continuously replenished through passage 49. When valve 48 is closed, fuel will continue to be replenished in reservoir 51 so that it fills up to the fuel level in float bowl chamber 53. When it is desired to start engine 10 and control valve 48 is opened, an immediate supply of fuel is available from reservoir 51 without having to flow through restrictive passage 49.

The herein described device uses pressure in one crankcase to move the fuel so that it enters the opposite crankcase quickly to assist in easier starting. The device operates independently of manifold vacuum and will function at any throttle setting.

I claim:

1. In an internal combustion engine, the combination comprising:

(a) a cylinder block having first and second pistons reciprocable in opposite directions within first and second cylinders, (b) first and second crankcases associated with said first and second pistons, (c) means mounted to said engine for supplying a fuel-air mixture to said first and second crankcases alternately upon reciprocation of said first and second pistons, (d) and means responsive to pressure in each crankcase for supplying a supplemental charge of fuel alternately to said crankcases upon reciprocation of said pistons during starting of said engine, said supplemental charge supplying means operative upon reciprocation of said first piston in one direction and said second piston in the opposite direction to inject fuel into said first crankcase by the pressure developed within said second crankcase by said second piston, and upon reciprocation of said first piston in the said opposite direction and said second piston in the said one direction to inject fuel into said second crankcase by the pressure developed within said first crankcase by said first piston.

2. The combination of claim 1 in which said supplemental charge supplying means comprises first and second fuel receiving passages joined by a common passage and connected to supply fuel respectively to said first and second crankcases so that, upon reciprocation of said first and second pistons, the direction of fuel flow within said first and second passages and said common passage is reversed to provide alternate pressurized injections of fuel into said first and second crankcases.

3. In an internal combustion engine, the combination comprising:

(a) a cylinder block having first and second pistons reciprocable in opposite directions within first and second cylinders, (b) first and second crankcases associated with said first and second pistons, (c) means mounted to said engine for supplying a fuel-air mixture to said first and second crankcases alternately upon reciprocation of said first and second pistons, (d) means responsive to pressure in each crankcase for supplying a supplemental charge of fuel alternately to said crankcases upon reciprocation of said pistons during starting of said engine, said supplemental charge supplying means operative upon reciprocation of said first piston in one direction and said second piston in the opposite direction to inject fuel into said first crankcase by the pressure developed within said second crankcase by said second piston, and upon reciprocation of said first piston in the said opposite direction and said second piston in the said one direction to inject fuel into said second crankcase by the pressure developed within said first crankcase by said first piston, (e) said fuel-air mixture supplying means including a carburetor having a float bowl, (f) and said supplemental charge supplying means comprising first and second passage means joined by a common passage adapted to receive fuel from said float bowl of said carburetor and with said first and second passage means connected respectively to said first and second crankcases, (g) said first and second passage means and said common passage forming a supplemental fuel connection within which the direction of fuel flow is reversed in response to piston reciprocation to provide alternate pressurized injections of fuel into said first and second crankcases.

4. The combination of claim 3 which includes:

(a) a restrictive passage connecting said float bowl with said common passage, (b) and selectively actuatable one-way valve means disposed generally between said float bowl and said common passage for permitting fuel entry into said first and second passage means from said restrictive passage.

5. The combination of claim 4:

(a) in which said float bowl includes a partition separating said bowl into a primary fuel chamber and a fuel enrichment reservoir, (b) said restrictive passage being disposed in said partition and connection said primary fuel chamber and said reservoir.

6. The combination of claim 5 in which said common passage communicates with said reservoir.

7. In an internal combustion engine, the combination comprising:

(a) a cylinder block having first and second pistons reciprocable in opposite directions within first and second cylinders, (b) first and second crankcases associated with said first and second pistons, (c) means mounted to said engine for supplying a fuel-air mixture to said first and second crankcases alternately upon reciprocation of said first and second pistons, (d) means responsive to pressure in each crankcase for supplying a supplemental charge of fuel alternately to said crankcases upon reciprocation of said pistons during starting of said engine, said supplemental charge supplying means operative upon reciprocation of said first piston in one direction and said second piston in the opposite direction to inject fuel into said first crankcase by the pressure developed within said second crankcase by said second piston, and upon reciprocation of said first piston in the said opposite direction and said second piston in the said one direction to inject fuel into said second crankcase by the pressure developed within said first crankcase by said first piston, (e) said fuel-air mixture supplying means including a carburetor having a float bowl, (f) said supplemental charge supplying means comprising first and second passage means joined by a common passage adapted to receive fuel from said float bowl of said carburetor and with said first and second passage means connected respectively to said first and second crankcases, (g) said first and second passage means and said common passage forming a supplemental fuel connection within which the direction of fuel flow is reversed in response to piston reciprocation to provide alternate pressurized injections of fuel into said first and second crankcases, (h) said fuel-air mixture supplying means further including inlet valve means connecting said carburetor with said first and second crankcases for alternately supplying said fuel-air mixture to aid crankcases, (i) said first and second passage means bypassing said inlet valve means.

8. The combination of claim 7:

(a) in which said carburetor includes a base member mounted to said engine, (b) and a plate confined between said base member and said engine, (c) said first passage communicating through a short groove in said base member to a first opening in said plate and hence into said first crankcase, (d) said second passage communicating through an elongated arcuate groove in said base member to a second opening in said plate generally diametrically opposed from said first opening and hence into said second crankcase.

* * * * *